US007656362B2

(12) United States Patent
Alberding et al.

(10) Patent No.: US 7,656,362 B2
(45) Date of Patent: Feb. 2, 2010

(54) BREATHABLE RADOME

(75) Inventors: Mark R. Alberding, Glen Arm, MD (US); James P. Loebach, Bel Air, MD (US); Tushar K. Shah, Columbia, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 104 days.

(21) Appl. No.: 11/427,225

(22) Filed: Jun. 28, 2006

(65) Prior Publication Data

US 2008/0001841 A1 Jan. 3, 2008

(51) Int. Cl.
*H01Q 1/42* (2006.01)

(52) U.S. Cl. ..... 343/872

(58) Field of Classification Search ..... 343/872
See application file for complete search history.

(56) References Cited

U.S. PATENT DOCUMENTS

| | | | | |
|---|---|---|---|---|
| 5,793,608 | A * | 8/1998 | Winick et al. | 361/695 |
| 5,831,830 | A * | 11/1998 | Mahler | 361/704 |
| 5,892,481 | A * | 4/1999 | Andersson | 343/700 MS |
| 5,986,618 | A * | 11/1999 | Aakula et al. | 343/872 |
| 6,028,565 | A * | 2/2000 | Mackenzie et al. | 343/872 |
| 6,064,344 | A * | 5/2000 | Walton | 343/704 |
| 6,767,606 | B2 * | 7/2004 | Jackson et al. | 428/118 |
| 2007/0035468 | A1 * | 2/2007 | Kuroda et al. | 343/911 L |

* cited by examiner

*Primary Examiner*—Trinh V Dinh
*Assistant Examiner*—Dieu Hien T Duong
(74) *Attorney, Agent, or Firm*—DeMont & Breyer, LLC

(57) ABSTRACT

A "breathable" radome that has an air-permeable structure is disclosed. The air-permeable structure permits a relatively greater flow of cooling air to be drawn over the radiating elements of an air-cooling system that is used for the electronics that are being sheltered by the radome. The increase in cooling efficiency that results from the use of the breathable radome enables air-cooled systems to be used with relatively higher-powered electronics.

15 Claims, 3 Drawing Sheets

BREATHABLE RADOME

FIELD OF THE INVENTION

The present invention relates to radomes.

BACKGROUND OF THE INVENTION

The term "radome," which is a portmanteau word derived from the words radar and dome, originally referred to radar-transparent, dome-shaped structures that protected radar antennas on aircraft. Over time, its meaning has expanded to encompass almost any structure that protects a device, such as a radar antenna, that sends or receives electromagnetic radiation, such as that generated by radar, and is substantially transparent to the electromagnetic radiation. A radome can be flat, ogival, etc.; it need not be dome-shaped. Radomes are found on aircraft, sea-faring vessels, and on the ground.

Radomes typically have a solid, exterior "skin" for isolating antennas, etc., and accompanying electronics from the ambient environment (e.g., weather and other environmental influences). Radomes usually comprise either (1) solid foams or (2) cellular cores (e.g., honeycomb, etc.) with solid facing sheets that are formed of a fiber-reinforced composite material. The radome must, of course, be substantially transparent to radio-frequency radiation.

The electronics that radomes protect generate heat. In high-power systems, liquid-cooling must be used to dissipate the substantial heat load generated by the electronics. But liquid cooling systems are heavy and relatively complex, which is undesirable, particularly for use in air craft and naval vessels.

Air cooling is a lower-weight, lower-complexity alternative to liquid cooling. Air-cooled systems rely on the thermal conductivity of the radome's structural materials and the efficient routing of air flow over electronics to provide cooling. But radomes are typically made from composite materials, which are not well suited for thermal management. As a consequence, current air-cooled systems are limited to the relatively lower heat loads of low-power applications.

It would be desirable, therefore, to increase the effectiveness of air-cooled systems so that they can be used for the thermal management of higher-power antennas.

SUMMARY OF THE INVENTION

The present invention provides a radome that, relative to prior-art radomes, increases the efficiency of air-cooled systems that are used for dissipating heat from antenna systems or other electronics.

The illustrative embodiment of the invention is a "breathable" radome that has a structure that permits a flow of air to pass through it. In other words, it is not simply "air-permeable," but actually enables a flow of air to pass. This structure permits a relatively greater flow of cooling air to be drawn over the radiating elements of the electronics' air-cooling system than prior-art radomes. The increase in cooling that results from the use of the breathable radome enables air-cooled systems to be used with relatively higher-powered electronics than previously possible.

A breathable radome in accordance with the illustrative embodiment of the present invention comprises:

a frame;

a cellular or otherwise open-structured core; and two layers of a perforated composite material that sandwich the core.

In some embodiments, an air-permeable and optionally waterproof fabric is provided over the outer perforated composite.

In a first alternative embodiment of the invention, the layers of composite material are contourable or formable such that a separate frame is not required to give the radome a form or shape. In a second alternative embodiment, a "non-structural" breathable radome is provided. As used herein, the term "non-structural radome" means a radome whose structure is not load sharing. In some embodiments of non-structural breathable radomes that are disclosed herein, the cellular core is not included. Rather, the radome includes an air-permeable, water-impermeable, electromagnetically-transparent material that is supported by a frame.

In some embodiments, the air for the air-cooling system is drawn inward through the breathable radome and over the radiating elements. In some other embodiments, the air is drawn in through vents and exhausted through the radome after having passed over the radiating elements.

It is anticipated that the breathable radome disclosed herein will be used with a variety of electronics systems. As will be appreciated by those skilled in the art, such a variety of systems are likely to have widely varying thermal requirements. To that end, the breathable radome disclosed herein and other elements of the cooling system are highly tailorable to the thermal requirements of any specific application.

DETAILED DESCRIPTION

The following terms are defined for use in this Specification, including the appended claims:

Electrically-coupled means that two objects are in electrical contact. This can be via direct physical contact (e.g., a plug in an electrical outlet, etc.), via an electrically-conductive intermediate (e.g., a wire that connects devices, etc.), or via intermediate devices, etc. (e.g., a resistor electrically connected between two other electrical devices, etc.).

Layer means a substantially-uniform thickness of a material covering a surface. A layer can be either continuous or discontinuous (i.e., having gaps between regions of the material). For example, a layer can completely cover a surface, or be segmented into discrete regions, which collectively define the layer (i.e., regions formed using selective-area epitaxy).

Mechanically-coupled means that two or more objects interact with one another such that movement of one of the objects affects the other object. For example, consider an actuator and a platform. When triggered, the actuator causes the platform to move. The actuator and the platform are therefore considered to be "mechanically-coupled." Mechanically-coupled devices can be, but are not necessarily, physically coupled. In particular, two devices that interact with each other through an intermediate medium are considered to be mechanically coupled but not physically coupled. Continuing with the example of the platform and the actuator, if the platform supports a load such that the load moves when the platform moves (due to the actuator), then the actuator and the load are considered to be mechanically coupled as well.

Operatively-coupled means that the operation of one object affects another object. For example, consider an actuator that is actuated by electrical current, wherein the current is provided by a current source. The current source and the actuator are considered to be "operatively-coupled" (as well as "electrically coupled"). Operatively-coupled devices can be coupled through any medium (e.g., semiconductor, air, vacuum, water, copper, optical fiber, etc.) and involve any type of force. Consequently, operatively-coupled objects can be electrically-coupled, hydraulically-coupled, magnetically-coupled, mechanically-coupled, optically-coupled, pneumatically-coupled, thermally-coupled, etc.

Physically-connected means in direct, physical contact and affixed (e.g., a mirror that is mounted on a linear-motor).

Physically-coupled means direct, physical contact between two objects (e.g., two surfaces that abut one another, etc.).

Radome means any structure used to protect electromagnetic radiation equipment (e.g., radar equipment, etc.) that is aircraft, ground or ship-based.

Thermally-coupled means that two or more objects exchange heat. This can be via direct physical contact (i.e., conduction), or by convection or radiation.

Figure 1:
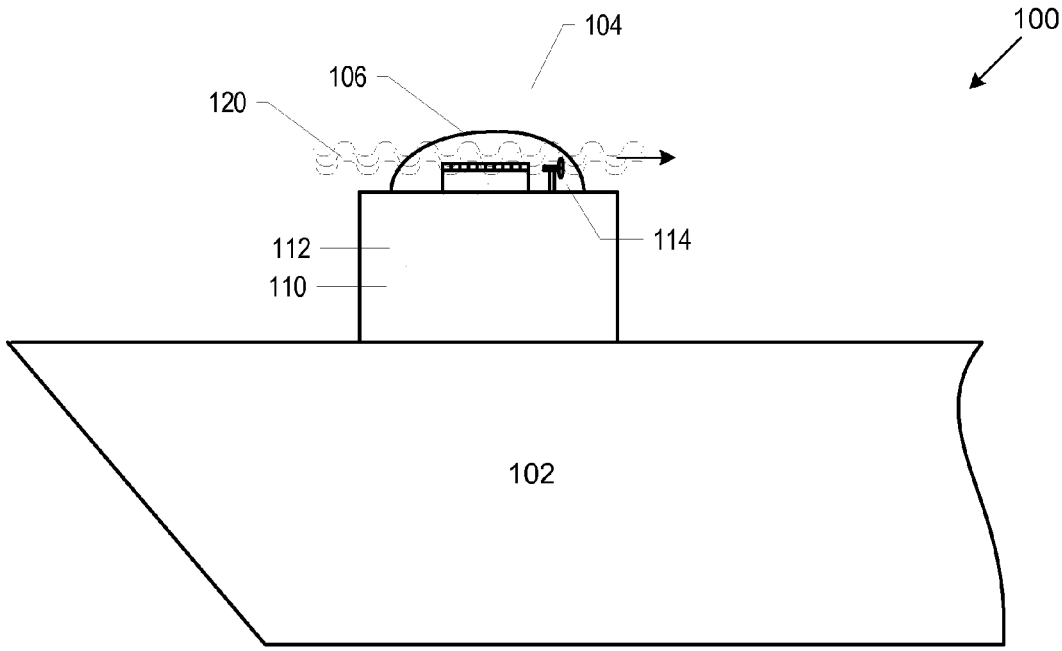
FIG. 1 depicts an air-cooled electronics system and a breathable radome in accordance with the illustrative embodiment of the present invention.

FIG. 1 depicts vessel 100 having hull 102 and radar system 104. The radar system, which is disposed above hull 102, includes a radar antenna (not depicted), radar electronics 110, heat-radiating elements 112, and fan 114. The heat-radiating elements and the fan are a part of an air-cooling system that is used to remove the heat generated by radar electronics 110.

Radar system 104 is protected by breathable radome 106. In addition to providing conventional radome functionality (e.g., environmental protection, etc.), breathable radome 106 is specially adapted to pass a flow 120 of air. Due to the flow-through nature of radome 106, a greater quantity (i.e., mass) of air can be flowed over heat-radiating elements 112 than would otherwise be the case. As a consequence, the air-cooling system can dissipate more heat than prior-art air-cooling systems in which air flows less freely. Since breathable radome 106 improves the operation of the air-cooling system, it can be considered to be part of the air-cooling system.

Notwithstanding its etymology, a "radome" need not be dome-shaped. Although the radome that is depicted in FIG. 1 is, indeed, dome-shaped, FIG. 2 depicts an embodiment of a radome that is not so shaped.

Figure 2:
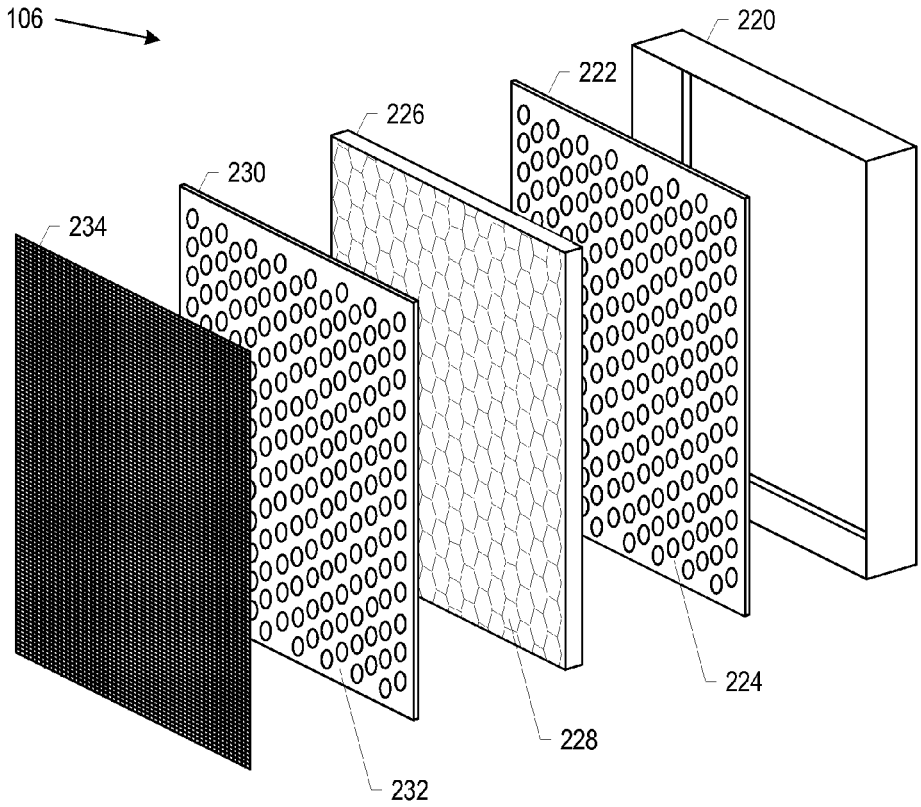
FIG. 2 depicts a cross-section of the breathable radome of FIG. 1.

FIG. 2 depicts an "exploded" view of radome 106. In the embodiment that is depicted in FIG. 2, radome 106 comprises multiple "layers" of material. In particular, radome 106 comprises "inner" composite layer 222, core 226, "outer" composite layer 230, and outer fabric layer 234. All these layers must be electromagnetically-transparent, at least for embodiments in which the system that the radome protects is sending/receiving electromagnetic radiation.

In the embodiment that is depicted in FIG. 2, the various layers of radome 106 are retained by frame 220. In FIG. 2, frame 220 is depicted as having a rectangular shape, rather than a dome shape. In this embodiment, wherein frame 220 has solid sides, air would be pass through the opening in the frame, which is covered by layers 222, 226, 230, and 234. In other embodiments, frame 220 can be formed in any of a variety of shapes and geometries, such as spherical, hemispherical, conical, ogival, etc.

An inner layer (like inner layer 222) and an outer layer (like outer layer 230) are often present in prior-art radomes. These composite layers are usually formed from polymer matrix composites such as epoxy or cyanate ester, with quartz or fiberglass reinforcement. In the prior art, and unlike layers 222 and 230 of radome 106 in accordance with the present invention, these composite layers are typically solid. In radome 106, inner composite layer 222 and outer composite layer 230 are perforated to enable a flow of air to pass these layers. In particular, inner layer 222 includes perforations 224 and outer layer 230 includes perforations 232.

The perforated inner layer 222 and perforated outer layer 230 flank or "sandwich" core layer 226. The core layer, which is often present in prior-art radomes, has an open structure (e.g., cellular, perforated, etc.) that permits a flow of air to pass. In the embodiment that is depicted in FIG. 2, the core has a cellular structure. The cellular structure of this embodiment is honeycombed, but other geometries can be used. Core layer 226 is made from any of a variety of radar-transparent materials, including polyetherimide thermoplastic and fiberglass/phenolic. Some prior-art radomes use a solid foam core, but this would not be suitable for use with the radomes disclosed herein, since such solid foam cores would not pass a flow of air.

Since outer composite layer 230 is perforated, it is desirable to cover it with a material that provides a barrier to water intrusion (e.g., rain, snow, ice, etc.) In some embodiments, layer 230 is covered by a fabric that is water-impermeable and that permits a flow of air to pass. The material is advantageously robust enough to withstand anticipated environmental conditions. Suitable materials include, without limitation, polytetrafluoroethylene (PTFE), polyester woven material, and PTFE-coated fiberglass.

In some embodiments, composite layers 222 and 230 are contoured or formed into a desired shape such that a separate frame (i.e., frame 220) is not required. In some further embodiments, especially those in which radome 106 is non-structural, core 226 is not present. In yet some additional embodiments, the core is formed to a desired shape.

Figure 3:
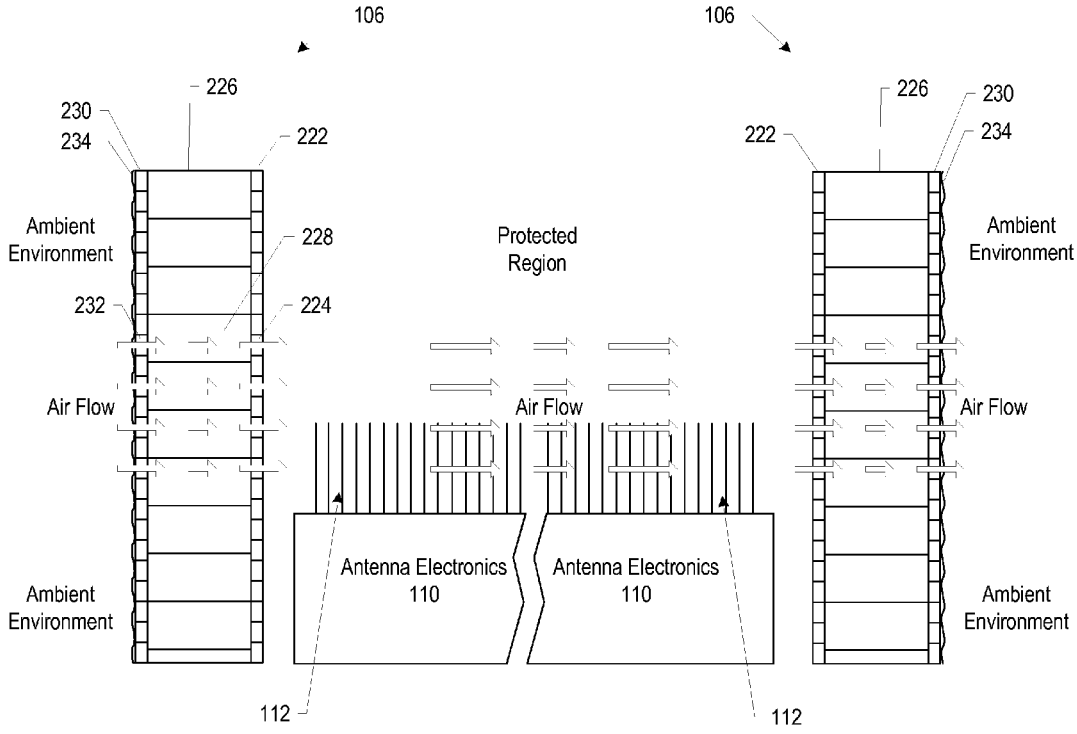
FIG. 3 depicts further detail of the breathable radome of FIG. 1, showing an illustrative composition.

FIG. 3 depicts further detail of FIG. 1, showing a cross-section of radome 106 and air flowing through the radome and over heat-radiating elements 112 of the air-cooling system. It will be appreciated that radome 106 completely encloses antenna electronics 110; the upper portion of the radome is not shown in FIG. 3.

FIG. 3 depicts air flowing into radome 106 (from left to right) through the various layers of radome 106. In particular, air flows through fabric 234, through perforations 232 in outer composite layer 230, through openings 228 in core 226, and through perforations 224 in inner composite layer 222. Within the "protected region" inside of radome 106, air flows over heat-radiating elements 112 of the air-cooling system that is used to remove heat that is generated by antenna electronics 110. A fan, not depicted in FIG. 3, draws the air over heat-radiating elements 112. After picking up heat from the heat-radiating elements, the air flows to the ambient environment through the various layers (e.g., layer 222, core 226, layer 230, and fabric 234) of radome 106.

As will be appreciated by those skilled in the art, the breathable radome disclosed herein is likely to be used in conjunction with a variety of different radar systems, some relatively higher-powered and others relatively lower powered. There can be significant differences in the amount of heat that is generated by such systems. Furthermore, the breathable radome disclosed herein will be used with other types of heat-generating electronics. As a consequence, heat load can vary greatly from application to application.

To that end, the breathable radome disclosed herein and other elements of the cooling system are highly tailorable to meet the thermal requirements of any specific application. In particular, the effectiveness of the breathable radome for heat removal is tailored via alterations in skin perforation size, the quantity of perforations in the skin, the inclusion or exclusion of a permeable fabric, fabric thickness and type, thermal conductivity of the composite materials, as well as other parameters.

Furthermore, other aspects of the system are alterable to meet specific thermal requirements. For example, to the extent that fans are present for cooling, the quantity, location, and flow rate of the fans are parameters that can be varied to meet thermal requirements. Also, in some cases, there will be freedom to select the geometry and orientation of the heat-generating electronics, which will have an impact on thermal requirements.

Those skilled in the art will be able to vary these parameters, as required, to satisfy the thermal requirements of any particular application.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. An apparatus comprising a radome for use with electronics equipment, wherein said radome comprises a shell that defines an internal environment and provides a barrier between said electronics equipment in said internal environment and an ambient environment, and wherein said shell comprises:

(a) a core, wherein said core has an open structure suitable for passing a flow of air; and (b) a first layer of a composite material proximal to said internal environment and a second layer of said composite material proximal to said ambient environment, wherein said first layer and said second layer sandwich said core, and wherein said first layer and said second layer are physically adapted to pass a flow of air, wherein the ability of said core, said first layer, and said second layer to pass a flow of air enables air-flow between said ambient environment and said internal environment.

2. The apparatus of claim 1 wherein said open structure of said core is cellular.

3. The apparatus of claim 2 wherein the geometry of said cellular and open-structure core is honeycomb.

4. The apparatus of claim 1 wherein said first layer and said second layer comprise perforations that permit the flow of air there through.

5. The apparatus of claim 1 wherein said shell further comprises a breathable fabric that covers said second layer of composite material.

6. The apparatus of claim 5 wherein said fabric is waterproof.

7. The apparatus of claim 1 wherein said apparatus is a air-cooling system, and wherein said air-cooling system further comprises heat-radiating elements, wherein said heat-radiating elements are disposed in said internal environment and are thermally coupled to said electronics equipment.

8. The apparatus of claim 7 further comprising a fan, wherein said fan generates said air-flow and draws said air flow over said heat-radiating elements.

9. The apparatus of claim 7 wherein said electronics equipment comprises electronics for use in conjunction with an antenna.

10. The apparatus of claim 7 wherein said electronics equipment comprises electronics for use in conjunction with radar.

11. The apparatus of claim 1 wherein said electronics equipment comprises electronics for use in conjunction with an antenna.

12. The apparatus of claim 1 wherein said electronics equipment comprises electronics for use in conjunction with radar.

13. An apparatus comprising a radome for use with electronics equipment, wherein said radome comprises:

a shell that defines an internal environment and provides a barrier between said electronics equipment in said internal environment and an ambient environment, and wherein said shell comprises:

(a) a core, wherein said core has an open structure suitable for passing a flow of air; and (b) a first layer of a composite material proximal to said internal environment and a second layer of said composite material proximal to said ambient environment, wherein said first layer and said second layer sandwich said core, and wherein said first layer and said second layer are physically adapted to pass a flow of air;

and wherein the apparatus further comprises heat-radiating elements, wherein said heat-radiating elements are disposed in said internal environment and are thermally coupled to said electronics equipment for the purpose of removing heat from said electronics equipment.

14. The apparatus of claim 13 further comprising a fan, wherein said fan generates said flow of air and draws said flow of air over said heat-radiating elements.

15. An apparatus comprising a radome for use with electronics equipment, wherein said radome comprises:

a shell that defines an internal environment and provides a barrier between said electronics equipment in said internal environment and an ambient environment, and wherein:

(a) said shell is load sharing; and (b) said shell is physically adapted to enable air to flow between said ambient environment and said internal environment;

and wherein the apparatus further comprises:

heat-radiating elements, wherein said heat-radiating elements are disposed in said internal environment and are thermally coupled to said electronics equipment for the purpose of removing heat from said electronics equipment; and a fan, wherein said fan generates said flow of air and draws said flow of air over said heat-radiating elements through said shell to the ambient environment.

* * * * *